United States Patent [19]

Dominguez

[11] 4,084,477

[45] Apr. 18, 1978

[54] PROTECTIVE PAD FOR MUSICAL INSTRUMENTS

[76] Inventor: Richard Lee Dominguez, 3835 W. Eva Ave., Phoenix, Ariz. 85021

[21] Appl. No.: 734,341

[22] Filed: Oct. 20, 1976

[51] Int. Cl.[2] ..... G10D 3/00

[52] U.S. Cl. ..... 84/327; 84/280; 428/85; 428/95; 24/204

[58] Field of Search ..... 24/DIG. 18, 204; 84/328, 453, 327, 280, 281; 428/85, 95

[56] References Cited

U.S. PATENT DOCUMENTS

| | | | |
|---|---|---|---|
| 1,785,206 | 12/1930 | Overton | 84/328 |
| 3,316,669 | 5/1967 | Machbar | 24/DIG. 18 |
| 3,823,056 | 7/1974 | Cooney | 428/85 |

FOREIGN PATENT DOCUMENTS

| | | | |
|---|---|---|---|
| 413,545 | 11/1933 | United Kingdom | 84/280 |

*Primary Examiner*—Kenneth J. Dorner
*Attorney, Agent, or Firm*—Cahill, Sutton & Thomas

[57] ABSTRACT

A pad for protecting wood or other finished of articles such as guitars and basses, the pad including a major surface having a smooth, non-abrasive covering, and a plurality of pedestal-members including opposing hook and loop sections, one of which sections is bonded to the pad and the other of which is bondable to the article to be protected so that the pad can be releasably attached to the article by mating the hook and the loop sections.

4 Claims, 5 Drawing Figures

PROTECTIVE PAD FOR MUSICAL INSTRUMENTS

BACKGROUND OF THE INVENTION

This invention relates to a pad to protect the finish of articles such as musical instruments.

Musical instruments such as guitars and basses are generally played with the musician standing and the back of the instrument held against the musician's body. Relative movement between the instrument the musician's body causes marring of the often attractive and expensive finish of the back of the instrument. To date, there are two types of protection employed to alleviate the problem. One type is a protective pad equipped with snaps or buttons which attach to mating parts permanently mounted on the back of the instrument. Such a design requires drilling several holes at spaced points about the periphery of the back of the instrument. Such permanent disfigurement of the instrument detracts not only from its aesthetic qualities but from its tonal qualitites as well. Positioning of the mounting holes requires a qualified craftsman, adding further expense to the cost of this particular protective device. In addition to being relatively expensive, since the snap-on pad lies flat against the back of the instrument there is very little air circulation provided between the pad and the instrument, causing fading of the finish in the area covered by the pad.

This latter disadvantage is even more pronounced in the other type of protection currently available; a plastic sheet form fitted to the back of the instrument. This type of fitting prevents any substantial air circulation between the protection cover and the finish, allowing accumulation of dirt and grime. The abrasive nature of this dirt eventually ruins the finish the plastic sheet is intended to protect.

SUMMARY OF THE INVENTION

It is an object of the present invention to provide a protective article for the finishes of articles such as guitars, basses and the like.

It is a further object to provide such a protective article which is relatively inexpensive, easy to install, detachable, universal in fit, and permits air circulation between the article and the surface to be protected so as to prevent build up of abrasive materials.

These and other objects which will be apparent hereinafter are provided by a protective pad having a self supporting backing layer one major face of which is covered with a matt of soft, pliant fibers and the opposing face of which is covered with a smooth, non-abrasive fabric such as satin. Bonded to the fabric at spaced intervals are sections of hook or loop material in which the hooks or loops project outwardly away from the pad. Assuming the section bonded to the fabric has hook elements, a section of loop material is releasably coupled in face to face relationship to the section of hook material. The section of loop material includes a backing, on the reverse side of which there is a coating of an aggressively tacky, pressure sensitive adhesive. This latter section of loop material is bonded by means of the adhesive to the surface of the article to be protected.

The corresponding sections of hook and loop material form pedestals which serve to hold the pad in spaced relationship to the surface to be protected to avoid dirt accumulation between the pad and the surface, and prevent fading of the surface finish. After attaching the pad to the surface to be protected by means of the adhesive on the back of one of the sections of the pedestal, the pad can be removed by a peeling action which causes the pedestal to separate the hook section from the loop section, leaving the section which was bonded to the surface to be protected in place for reattachment of the pad when desired.

Figure 1:
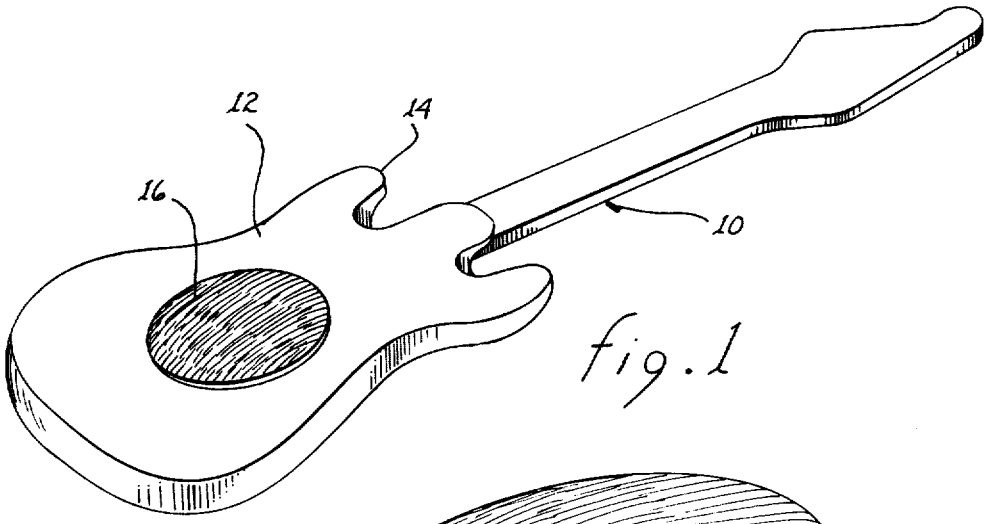
FIG. 1 is a perspective view of a guitar with the protective pad of the present invention attached to the back of a guitar.

Referring to FIG. 1, a guitar 10 is shown with the back 12 of body 14 partially covered with a protective pad 16.

Figure 2:
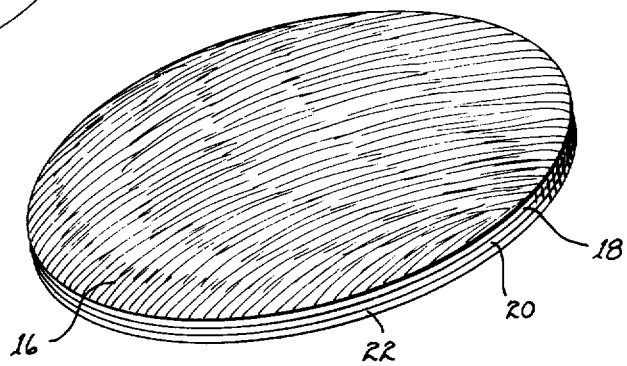
FIG. 2 is a perspective view of the protective pad.

As seen in FIG. 2, pad 16, which is preferably oval-shaped, has a three-layer construction; a first layer 18, a second intermediate layer 20, and a third layer 22. First layer 18 is composed of a mass of outwardly projecting fibers or hairs such as in provided by natural or imitation fur. Intermediate layer 20 provides the support for pad 16. A suitable intermediate layer 20 is a vinyl sheet approximately 0.020 in. (0.05 cm.) thick. Bonded to the underside of intermediate layer 20 is third layer 22. Third layer 22 is preferably a smooth, slick, tightly woven fabric such as satin. The first and third layers 18 and 22, respectively, may be bonded to intermediate layer 20 directly by softening the surface of intermediate layer 20 and pressing the layers 18 and 22 into the softened surface or indirectly by means of a suitable adhesive.

Figure 3:
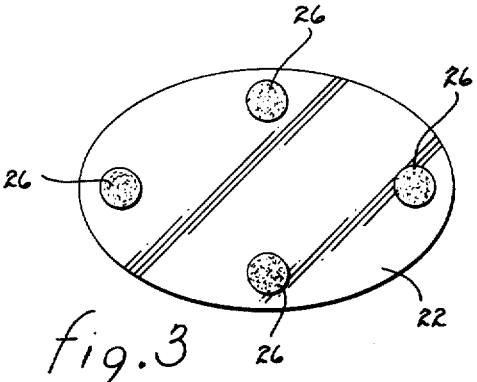
FIG. 3 is a plan view of the underside of the protective pad.

Referring to FIG. 3, to the surface of third layer 22 are attached four cylindrical-shaped pedestals 26 disposed in spaced relationship about the periphery of layer 22. Pedestals 26 are preferably adhesively bonded to third layer 22. Pedestal 26 is composed to two main sections 30 and 32.

Figure 4:
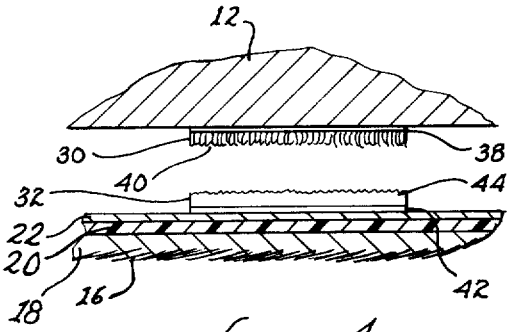
FIG. 4 is a sectional view taken along line 4—4 of FIG. 5 with portions of the pad separated.

As seen in FIG. 4, sections 30 and 32 are separated to illustrate the manner in which pad 16 is detached from the back 12 of guitar 10 when desired. Section 30, includes a backing 38 from which projects loop material 40 such as is sold under the trademark Velcro. Section 30 includes a backing 42 from which extends hook material 44. Section 32 is bonded to back 12 of guitar 10 by means of an agressively tacky, pressure-sensitive adhesive. The bond formed by this adhesive is relatively strong such that the force required to break the bond between backing 38 and the surface of back 12 exceeds the force required to disengage the releasable connection between hook material 44 and loop material 40.

Figure 5:
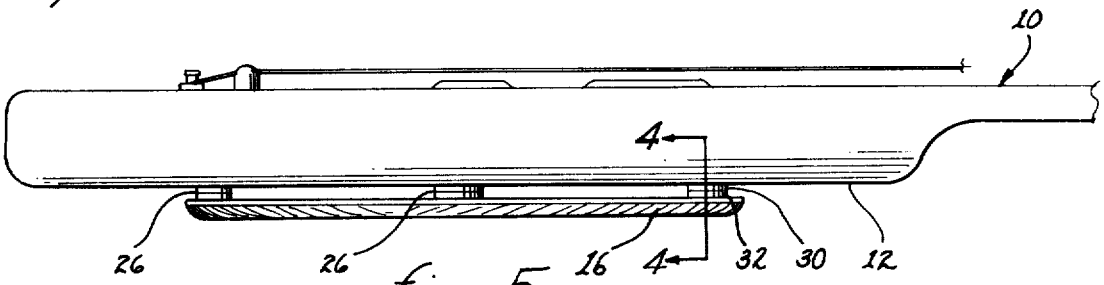
FIG. 5 is an elevational view of the pad of the invention attached to the back of a guitar.

FIG. 5 illustrates the manner in which pad 16 is attached to back 12. As can be seen from FIG. 5, pad 16 is held away from back 12 of guitar 10 so that air can circulate between pad 16 and back 12 and dirt, grime, and other abrasive material will not accumalate in between. To remove pad 16, the edge of pad 16 can be grasped and by a peeling action sections 30 and 32 of pedestal 26 are separated without disturbing the bond between section 30 and back 12 of guitar 10.

To initially attach pad 16, pad 16 is pressed against back 12, with backing 38 bearing the pressure-sensitive adhesive contacting back 12. Thereafter, pad 16 can be removed by a peeling action which separates section 30 from section 32, leaving section 30 bonded to back 12. Pad 16 can be reattached by pressing sections 30 and 32 together to engage the hooks and loops.

Pedestals 26 should be set back from the edge of pad 16 sufficiently so that the edge of pad 16 can be trimmed if desired. The bonds which form between the backing 42 and layer 22 and backing 38 and back 12 of guitar 10 are substantially stronger than the bond between sections 30 and 32, so that sections 30 and 32 can be separated without disturbing such other bonds. Nevertheless, by employing a suitable pressure-sensitive adhesive to bond sections 30 and 32 in place, the sections can be pryed loose and relocated if desired.

What is claimed is:

1. An article for protecting a surface finish of musical instruments such as guitars and basses comprising:

(a) a pad releasably secured to said surface in a position spaced from said surface, said pad comprising:
  (i) a self-supporting backing layer,
  (ii) a matt adherably bonded to and substantially covering a first major surface of said backing layer, said matt comprising a mass of soft, pliant fibers extending from said backing layer,
  (iii) a smooth, substantially non-abrasive layer bonded to and substantially covering a second major surface of said backing, said second major surface opposing said first major surface of said backing layer, and (b) a plurality of spaced pedestal members located on said non-abrasive layer, said pedestal members comprising a first section bonded to said non-abrasive layer and a second section adapted to be bonded to said surface to be protected, said first section comprising first mating means and said second section comprising second mating means, said mating means being mutually releasably couplable whereby said pad including said first section of said pedestal members can be releasably detached from said second section when said second section is bonded to the surface to be protected.

2. The article of claim 1 wherein said backing layer is composed of vinyl plastic.

3. The article of claim 1 wherein said first mating means is a plurality of loop members and said second mating means is a plurality of hook members.

4. The article of claim 1 wherein said first mating means is a plurality of hook members and said second mating means is a plurality of loop members.

* * * * *